US005941552A

United States Patent [19]

Beran

[11] Patent Number: 5,941,552

[45] Date of Patent: Aug. 24, 1999

[54] ADJUSTABLE SNOWBOARD BINDING APPARATUS AND METHOD

[75] Inventor: Mark A. Beran, Niwot, Colo.

[73] Assignee: BC Creations, Inc., Niwot, Colo.

[21] Appl. No.: 08/810,702

[22] Filed: Mar. 3, 1997

Related U.S. Application Data

[60] Provisional application No. 60/033,590, Dec. 20, 1996.

[51] Int. Cl.[6] ..... A63C 9/02

[52] U.S. Cl. ..... 280/607; 280/14.2; 280/618

[58] Field of Search ..... 280/14.2, 607, 280/617, 618, 11.33, 11.34, 624, 629, 630, 633; 441/70, 74; 403/93

[56] References Cited

U.S. PATENT DOCUMENTS

| | | | |
|---|---|---|---|
| 921,457 | 5/1909 | Purdum | 403/93 |
| 970,751 | 9/1910 | Pranke | 403/93 |
| 1,479,871 | 1/1924 | Pearson | 280/14.2 |
| 2,955,300 | 10/1960 | Hedlund et al. | 280/618 |
| 4,604,070 | 8/1986 | McKee et al. | 441/70 |
| 4,871,337 | 10/1989 | Harris . | |
| 5,021,017 | 6/1991 | Ott . | |
| 5,028,068 | 7/1991 | Donovan . | |
| 5,035,443 | 7/1991 | Kincheloe . | |
| 5,044,654 | 9/1991 | Meyer . | |
| 5,085,455 | 2/1992 | Bogner et al. . | |
| 5,236,216 | 8/1993 | Retzek . | |
| 5,261,689 | 11/1993 | Carpenter et al. . | |
| 5,277,635 | 1/1994 | Gillis . | |
| 5,354,088 | 10/1994 | Vetter et al. . | |
| 5,356,170 | 10/1994 | Carpenter et al. . | |
| 5,381,747 | 1/1995 | Hinde | 441/74 |
| 5,416,952 | 5/1995 | Dodge . | |
| 5,433,636 | 7/1995 | Gillis | 441/74 |
| 5,499,837 | 3/1996 | Hale et al. . | |
| 5,520,406 | 5/1996 | Anderson et al. . | |
| 5,544,909 | 8/1996 | Laughlin et al. . | |
| 5,553,883 | 9/1996 | Erb . | |
| 5,660,410 | 8/1997 | Alden | 280/14.2 |
| 5,762,358 | 6/1998 | Hale | 280/607 |
| 5,810,370 | 9/1998 | Covert et al. | 280/14.2 |
| 5,820,139 | 10/1998 | Grindl | 280/14.2 |

FOREIGN PATENT DOCUMENTS

| | | | |
|---|---|---|---|
| 432588 | 6/1991 | European Pat. Off. | 280/14.2 |

*Primary Examiner*—Daniel G. DePumpo
*Assistant Examiner*—Frank Vanaman
*Attorney, Agent, or Firm*—Harold A. Burdick

[57] ABSTRACT

A simple and lightweight, quick action snowboard binding securing device allows continuous rotational adjustment of the orientation of the binding with respect to the snowboard without the need for the removal of the rider's boot and without requiring the use of any tools. A clamping mechanism stiffens the binding and allows the rider's boot to rest directly on the binding for optimum performance. The device can be used with all bindings which have a central aperture to receive a securing disk or hold down plate.

21 Claims, 11 Drawing Sheets

ADJUSTABLE SNOWBOARD BINDING APPARATUS AND METHOD

RELATED U.S. PROVISIONAL PATENT APPLICATION

This Application is related to U.S. Provisional Patent Application No. 60/033,590 by Mark A. Beran (the inventor herein) filed Dec. 20, 1996, and makes claim to the invention disclosed therein.

FIELD OF THE INVENTION

This invention relates to snowboard bindings, and, more particularly, relates to adjustable binding systems for securing a rider's boots to the surface of a snowboard.

BACKGROUND OF THE INVENTION

Most snowboard binding systems being sold today use a circular disk to fasten the binding to the snowboard. The disk generally provides a pattern of slots for receipt of three or four bolts or screws which allows some adjustment of the position of the disk with respect to the longitudinal center line of the snowboard. When the disk is secured to the snowboard using screws it captures the binding and prevents it from moving in any manner with respect to the snowboard.

The binding itself may use straps to secure the rider's boot or it may be a step in type which automatically secures the boot when the rider steps into the binding. In either case the binding has a central hole through which at least a portion of the disk extends. In some cases the disk and the binding have tooth like profiles to mechanically engage the disk and binding so as to prevent the binding from turning with respect to the disk, and hence the snowboard, once the mounting screws are fastened. Other systems rely on a friction member between the disk and the binding, or simply the relative coefficient of friction of the disk and binding, which as a consequence of the axial force provided by the mounting screws prevents relative rotation of the binding and disk when the mounting screws are secured.

As will be apparent from the specific descriptions of prior art which follow, all of the currently known or utilized systems have at least one of the following inherent disadvantages: complexity, including many parts and therefore bulky or heavy mountings, undue production expense and/or lack of reliability; or inability to be easily reoriented without tools or with the rider's boot secured to the binding; or an undesirably large vertical offset between the bottom of the boot and the top of the snowboard; or failure to allow for small adjustments of the location of the rotation center of the binding with respect to the central axis of the snowboard; or allowance of only a finite number of discrete orientations of the binding with respect to the snowboard; or requirement for special hole patterns in the snowboard in addition to, or instead of, the industry standard patterns used for securing disks to snowboards; or no adjustability to allow rotational slip when a prescribed torque is applied.

U.S. Pat. No. 5,553,883 teaches a device which allows adjustment of the orientation of the binding with respect to the snowboard central axis. It is, however, limited to discrete angular positions and requires a mating circular pattern of holes in the snowboard. This mating hole pattern is undesirable because it is expensive, weakens the snowboard and most importantly does not allow for any adjustment to the location of the pivot axis with respect to the snowboard central axis.

U.S. Pat. No. 5,261,689 teaches the hold down plate with at least three holes extending in a common direction, a base plate forming a part of a binding for receiving the boot of a user and having an aperture for receiving the hold down plate in at least two rotational orientations, and a means defining a pattern of second holes in a snowboard formed such that first holes are aligned with a like number of second holes when the hold-down plate is placed over the snowboard for permitting the hold down plate to assume at least two spaced apart positions along the snowboard, each corresponding to a different rotational orientation of the hold down plate.

This patent teaches the means to orient the hold down plate in at least two different orientations with respect to the snowboard central axis. This capability is afforded by the unique pattern of holes in the snowboard and in the hold down plate.

U.S. Pat. No. 5,236,216 teaches a hold down disk which allows a continuous selection of orientation angles of the binding with respect to the central snowboard axis. The means by which the rotation of the base plate with respect to the hold down plate is arrested involves a friction lining in combination with the axial force of the fasteners which has a direction generally normal to the surface of the snowboard.

U.S. Pat. No. 5,354,088 teaches another device which allows a finite number of discrete angular orientations of the boot with respect to the snowboard. An inherent consequence of this device is that the boot is substantially raised above the surface of the snowboard. This device does not require a plurality of holes in the snowboard itself.

U.S. Pat. No. 5,028,068 teaches a device for pivotally mounting a snowboard binding on a snowboard with a quick action handle and including a series of flexible bushings to absorb vibration and to flex when the user shifts his or her body weight. This system is complex and expensive, raises the users boot significantly above the surface of the snowboard due to the use of an adapter plate, and does not allow for small adjustments in the position of the rotation center with respect to the snowboard central axis.

Snowboard bindings which incorporate a central disk for securing the binding to the snowboard would also benefit from a convenient and fast means to rake small adjustments to the position of the disk center with respect to the longitudinal center line of the snowboard. The most important direction in which to allow such adjustment is perpendicular to the longitudinal center line of the snowboard (i.e., from side to side). Such an adjustment allows the rider's boot to be centered laterally on the snowboard and thereby eliminates toe and heel drag: conditions which occur when either the toe of the boot or the heel of the boot extends beyond the turning edge of the snowboard. When several different boot sizes are to be accommodated by a single binding, the lateral adjustment of the binding is critical. Virtually all disks sold today utilize either a three hole or four hole pattern of elongated slots which allow this type of adjustment. The biggest problem with the disks is that all of the disk mounting screws must be at least loosened, if not completely removed, in order to facilitate the lateral adjustment. This is time consuming, especially for rental shops.

As may be appreciated, further improvement of snowboard binding systems, allowing greater and simplified adjustability or flexibility for users, could thus yet be utilized.

SUMMARY OF THE INVENTION

This invention provides an adjustment mechanism for incorporation into a snowboard binding to allow rotational adjustment and ready free rotation, and method for modifying bindings to accommodate such movement. The primary subsystems of this snowboard binding are the central disk, the binding base plate and the adjustment mechanism. This invention requires only small changes to currently available components. Such modifications are easily accomplished and can be integrated into the manufacturing processes currently used to produce these parts with minimal tooling costs. The mechanism preferably includes a clamping mechanism for rotationally restraining the binding at the disk.

This invention overcomes the shortcomings and disadvantages of heretofore known and/or utilized adjustable bindings, which include complexity, high cost, difficulty of adjustment, limited angular orientations, vertical offset between the bottom of the rider's boot and the top of the base plate, no adjustment to the rotation center of the binding with respect to the snowboard central axis, or special non-industry standard hole patterns in the snowboard.

This invention provides an inexpensive, lightweight, and reliable means to secure the binding to the snowboard which allows quick, continuously adjustable, reorientation of the binding with respect to the snowboard without the necessity of removing or loosening the mounting screws or the rider's boot and without the need for any tools (i.e., toolless release and adjustment). There is thus provided greater rotational adjustability for different users, as well as rotational release allowing relatively free rotational movement of a user's foot and boot relative to the snowboard to accommodate more flexible user movement (for example, when negotiating mounting of a ski lift and/or moving through ski lift lines with the rear boot free of the snowboard).

The rotationally adjustable binding for binding a user's boot to a top surface of a snowboard of this invention includes a base plate configured to be supported by the top surface of the snowboard and to receive the user's boot, the base plate having an aperture therein and an outer edge with the aperture configured for receipt therethrough of a typical securing member, such as a securing disk. A continuous slot is formed between the aperture and the outer edge thus defining first and second base plate portions at each side of the slot, the slot having a width between the base plate portions.

A rotational release and securement means is connected with the base plate adjacent to the continuous slot (at both of the base plate portions) and includes a manipulable portion, preferably a manually manipulable member. The rotational release and securement means selectively governs the width of the slot and thereby relationship of the aperture to the securing member by user movement of the manipulable portion between rotational release and rotationally secure positions. The base plate is rotatable relative to the securing member when the manipulable portion is moved to the rotational release position and is secured from rotation relative to the securing member when the manipulable portion is moved to the rotationally secure position.

The invention may be embodied in only portions of known bindings or in an entire replacement binding system that includes the securing member. The securing member has an arcuate shank receivable through the aperture of the base plate (and in contact with the base plate thereat) and a shoulder for restraining the base plate between the shoulder and the snowboard.

The method for modifying a snowboard binding to accommodate toolless rotational release and reorientation of the binding relative to the snowboard of this invention includes the steps of forming a slot in the base plate between the aperture and an outer edge thereof, and connecting user manipulable release and securement means with the base plate adjacent to the slot for selectively manipulating width of the slot.

Another inventive aspect of this disclosure provides means to quickly, reliably and conveniently adjust the binding location laterally on a snowboard so that a particular rider's boot may be centered laterally on the snowboard. This lateral adjustment device of the invention works with both standard three and four hole mounting patterns, and is both inexpensive and lightweight.

The laterally adjustable snowboard binding anchoring device of this invention includes a track connectable to the snowboard with a connector constrained by and yet linearly movable along the track. A clamping member configured for retaining the binding and having an aperture therein is secured by securing means releasably engagable with the connector through the aperture of the clamping means.

Accordingly, it is an object of this invention to provide an improved rotationally adjustable snowboard binding apparatus and method.

It is another object of this invention to provide a means for quick, toolless, change over of stance position for the rider.

It is another object of this invention to provide a convenient means for setting up a snowboard binding to accommodate the needs of all riders, whether they are left or right footed.

It is another object of this invention to allow the rider to reduce stress and fatigue while riding chair lifts and maneuvering through lift lines by allowing quick changes to stance position as dictated by the situation at hand.

It is another object of this invention to allow the customization of the performance characteristics of the binding by fine tuning the location of the rotation center of the binding and the angular orientation of the binding with respect to the snowboard longitudinal center line.

It is another object of this invention to provide an inexpensive, reliable, and lightweight means to secure the binding to the snowboard.

It is another object of this invention keep the bottom of the rider's boot immediately above the base plate.

It is another object of the invention to selectively alter the flex characteristics of the binding to either increase or decrease the deflection of the binding when a given force is applied by the rider.

It is another object of the invention to provide a continuously adjustable orientation of the binding with respect to the snowboard central axis which can be limited between a specific angular range less than 360 degrees.

It is another object of the invention to provide a means to allow the binding to rotate with respect to the securing disk when a prescribed torque is applied to the binding.

It is another object of the invention to provide an apparatus and method for allowing selected free binding rotation which can easily be used in conjunction with a large number of snowboard bindings available today including both those with and those without flanges.

It is another object of this invention to provide a rotationally adjustable means for securing a user's foot or boot to sports equipment.

It is still another object of this invention to provide a rotationally adjustable binding for binding a user's boot to a top surface of a snowboard, the binding anchorable to the snowboard by a securing member that is attached to the snowboard, the binding including a base plate configured to be supported by the top surface of the snowboard and to receive thereat the user's boot, the base plate having an aperture therein and an outer edge with the aperture configured for receipt therethrough of the securing member, a continuous slot being formed between the aperture and the outer edge thus defining first and second base plate portions at each side of the slot, the slot having a width between the base plate portions, and rotational release and securement means connected with the base plate adjacent to the continuous slot and including a manipulable portion, the rotational release and securement means for selectively governing the width of the slot and thereby relationship of the aperture to the securing member by user movement of the manipulable portion between rotational release and rotationally secure positions, the base plate being rotatable relative to the securing member when the manipulable portion is moved to the rotational release position and secured from rotation relative to the securing member when the manipulable portion is moved to the rotationally secure position.

It is yet another object of this invent:on to provide a selectively freely rotatable binding for securing a user's boot to a top surface of a snowboard, the binding including a base plate configured to be supported by the top surface of the snowboard and to receive the user's boot thereat, the base plate having a central arcuate aperture therethrough and an outer edge, a continuous slot being formed between the aperture and the outer edge thus defining first and second base plate portions at each side of the slot, the slot having a width between the base plate portions, a securing member having an arcuate shank receivable through the aperture of the base plate and a shoulder for restraining the base plate between the shoulder and the snowboard, the securing member being connectable to the snowboard, the base plate being in contact with the shank at the aperture, and rotational release and securement means connected with the base plate at each of the base plate portions adjacent to the continuous slot and including a manually manipulable portion, the rotational release and securement means for selectively governing the width of the slot and thereby contact relationship of the aperture and the shank of the securing member by user movement of the manually manipulable portion.

It is still another object of this invention to provide a method for modifying a snowboard binding to accommodate toolless rotational release and reorientation of the binding relative to the snowboard, the binding including a base plate for receiving a user's boot thereat between edges thereof and a securing member receivable through an aperture in the base plate and affixable to the snowboard, the method including the steps of forming a slot in the base plate between the aperture and an outer edge thereof, and connecting user manipulable release and securement means with the base plate adjacent to the slot for selectively manipulating width of the slot.

It is yet another object of this invention to provide means to quickly, reliably and conveniently adjust binding location laterally on a snowboard.

It is still another object of this invention to provide a laterally adjustable snowboard binding anchoring device including track means connectable to the snowboard, a connector constrained by and yet linearly movable along the track means, clamping means configured for retaining the binding and having an aperture therein, and securing means releasably engagable with the connector through the aperture of the clamping means.

With these and other objects in view, which will become apparent to one skilled in the art as the description proceeds, this invention resides in the novel construction, combination and arrangement of parts substantially as hereinafter described, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

showing use of the device to adjust disk center line relative to a snowboard longitudinal center line.

DESCRIPTION OF THE INVENTION

Figure 1:
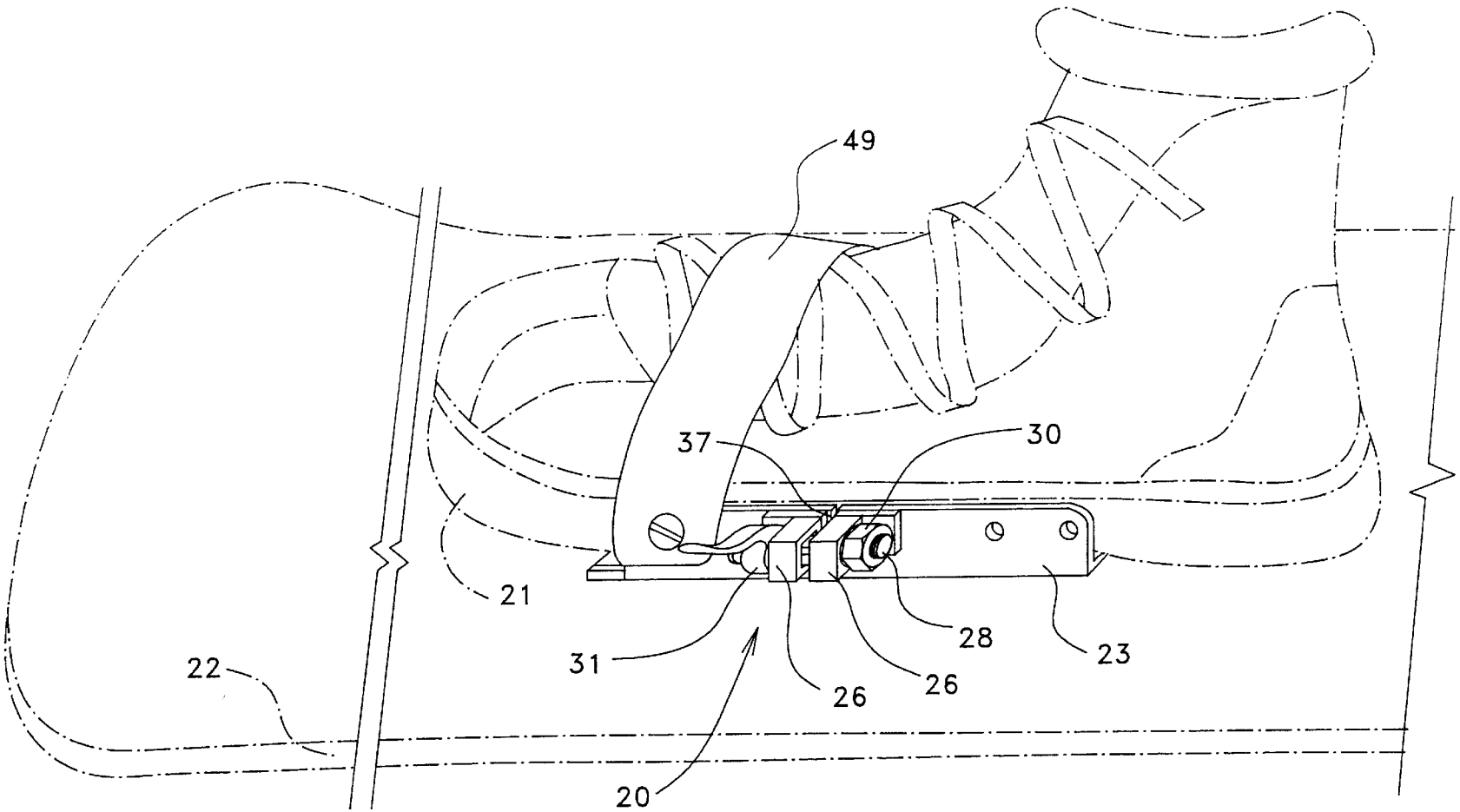
FIG. 1 is a perspective view showing the apparatus of this invention in use with a snowboard and snowboard binding.
Figure 2:
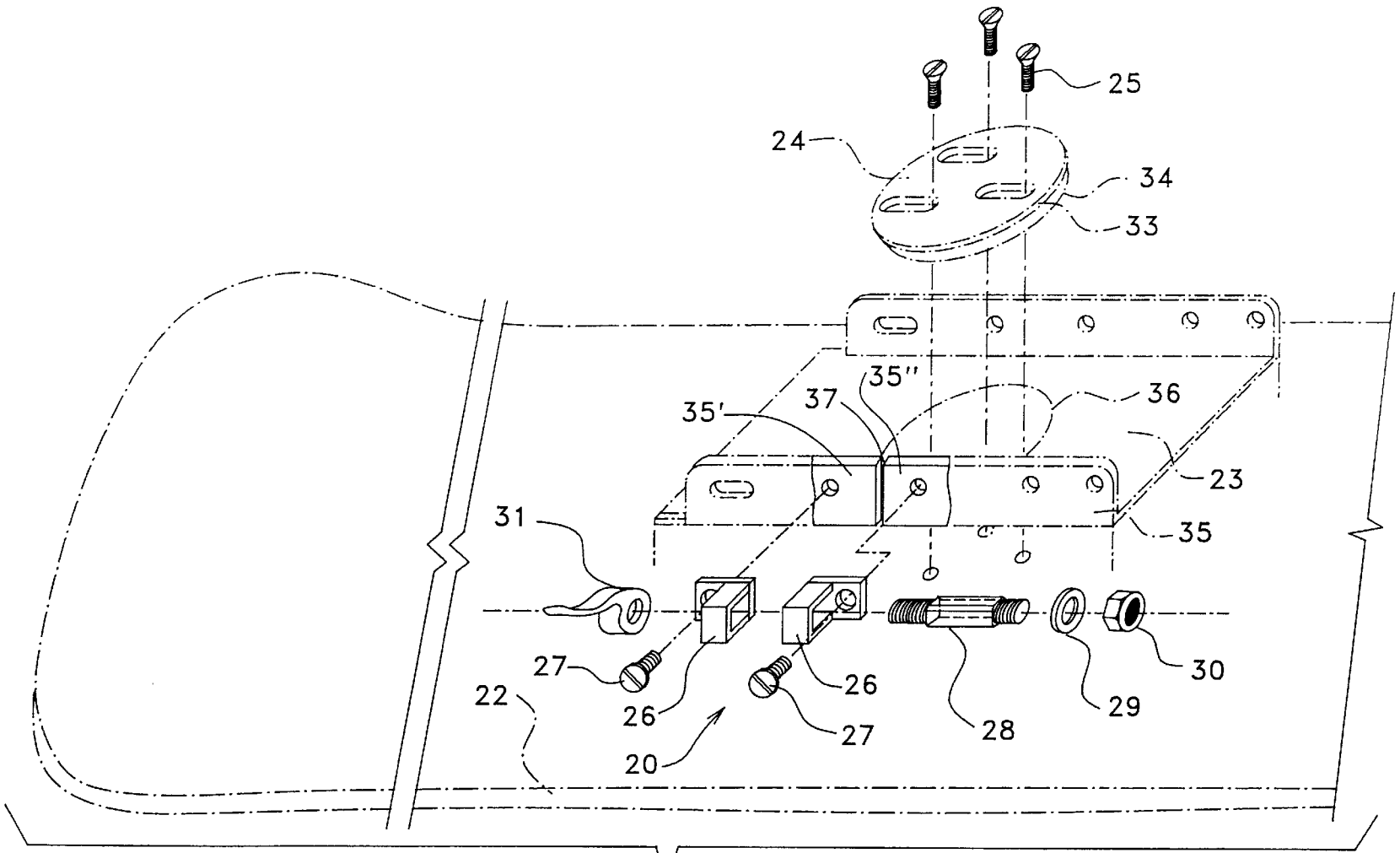
FIG. 2 is an exploded assembly view of the apparatus of this invention applied to a known snowboard and snowboard binding.

The overall binding system (including the modifications and mechanism 20 of this invention that accommodate ready rotational binding release and securement) is shown in FIGS. 1 and 2 for use in securing a user's boot 21 to the top surface of snowboard 22 by means of base plate 23. The system includes securing disk 24 which is fastened to snowboard 22 by screws 25. In accord with this invention, rotational release and securement modifications and mechanism 20 includes mounting blocks 26 secured to base plate 23 (one on each side of slot 37 hereinafter described) by screws 27 or other suitable means such as adhesive bonding, rivets, welding, or as integral inserts in the case of molded base plates. Slider 28 is linearly moveable within mounting blocks 26 with a close running fit. One end of the slider is threaded to receive washer 29 and preload nut 30. The other end of the slider is threaded to receive manually manipulable locking lever 31.

Figure 3:
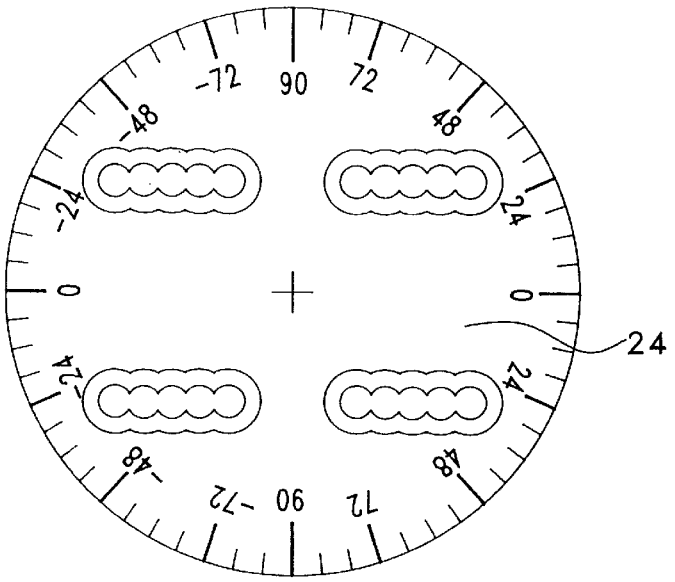
FIG. 3 (PRIOR ART)
FIG. 3 is a typical four hole securing disk known in the prior art.
Figure 4A:
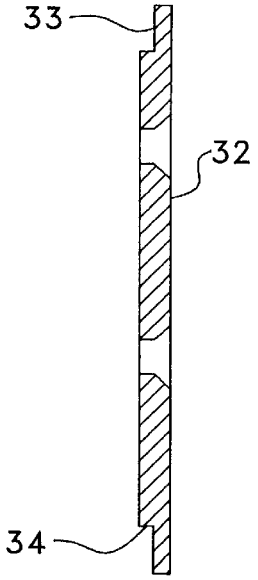
FIG. 4A (PRIOR ART)
FIG. 4A is a side view of a disk with shank and shoulder.
Figure 4B:
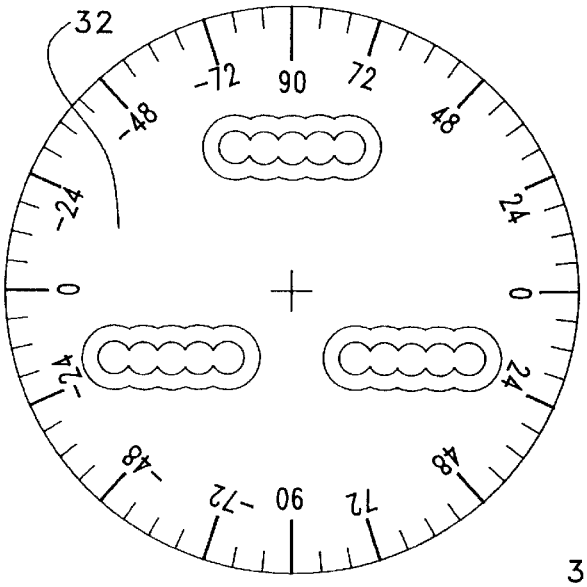
FIG. 4B (PRIOR ART)
FIG. 4B is a top view of a typical three hole disk known in the prior art.
Figure 5A:
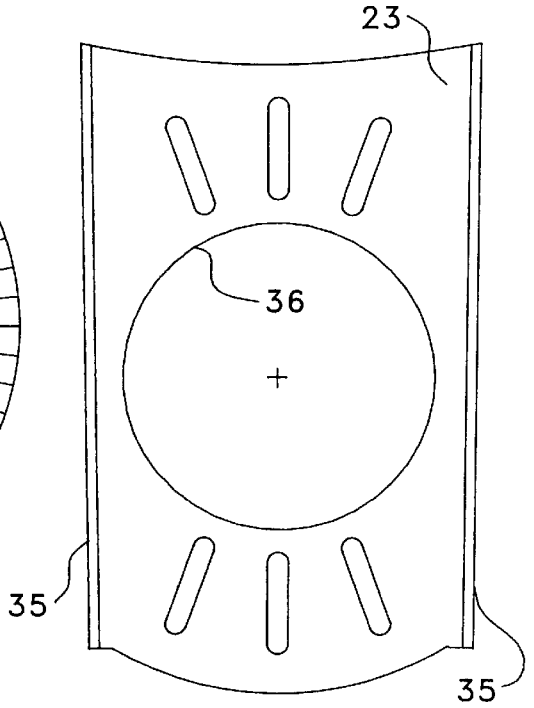
FIG. 5A (PRIOR ART)
FIG. 5A is a top view of a typical binding base plate with central hole known in the prior art.
Figure 5B:
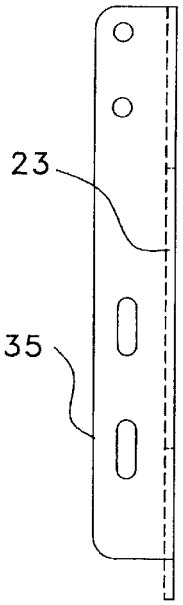
FIG. 5B (PRIOR ART)
FIG. 5B is a side view of a typical binding base plate with numerous holes and slots for mounting straps and accessories known in the prior art.

FIG. 3 shows a typical four hole mounting disk 24 which is known in the prior art. FIG. 4A is a side view of a typical three hole mounting disk 32 showing shoulder 33 and arcuate shank 34 (which also are found in four hole disk structures). FIG. 4B shows a top view of disk 32. FIG. 5A is a top view of a known type of binding base plate 23 with flanges 35 (which are used to anchor straps 49 which secure boot 21 to base plate 23 of the binding as well as to attach other auxiliary hardware essential to the binding system) and central hole, or aperture, 36 of arcuate (generally circular) configuration. FIG. 5B is a side view of the base plate shown in FIG. 5A and shows flange 35 with numerous typical holes and slots.

Figure 6:
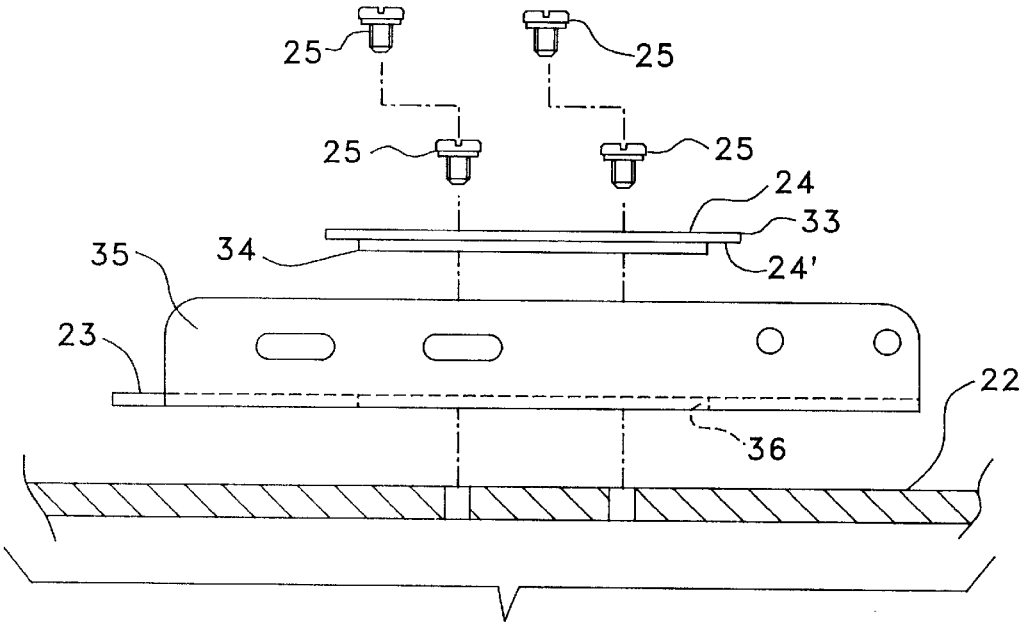
FIG. 6 (PRIOR ART)
FIG. 6 is an exploded assembly view of a disk, base plate and snowboard known in the prior art.

FIG. 6 is an exploded view of a typical prior art binding assembly (utilizing a disk 24 or 32 and base plate 23 having flanges 35). Binding base plate 23 is sandwiched, or restrained, between the top of snowboard 22 and the bottom surface 24' of shoulder 33 of disk 24 wherein a small amount of axial play, approximately 0.005" to 0.015", is required between shank 34 of disk 24 and hole 36 in binding base plate 23. This allows the binding to rotate with respect to the disk/snowboard by removing the boot and by loosening or removal of mounting screws 25.

Figure 7A:
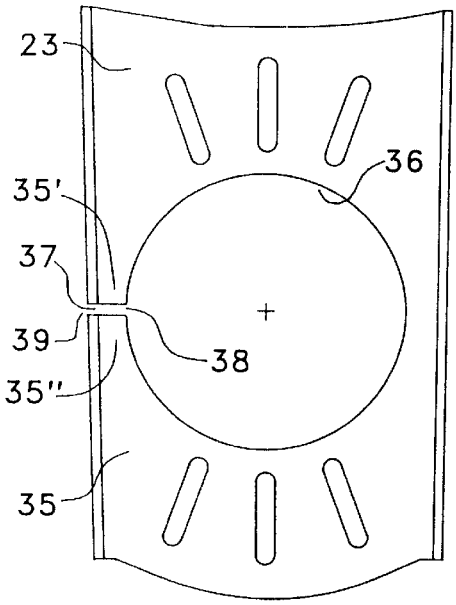
FIG. 7A is a top view of a binding base plate of this invention showing modification of a known base plate by a horizontal slot cut from the central aperture to an edge of the base plate.

FIG. 7A illustrates how use of the standard circular aperture in the binding base plate is modified in accord with this invention by cutting continuous slot 37 from a point 38 on the aperture (hole 36) circumference to a point on the outer edge 39 of base plate 23 (and through flange 35, where present) thus defining base plate portions 35' and 35". Typically this slot is straight or linear, but it can also be curved, and is approximately 0.025" in width. The slot sections the base plate, creating increased compliance and flexibility of the base plate in a direction generally perpendicular to that of the slot. The slot is shown cut horizontally (i.e., perpendicular to flange 35) in FIG. 7, but in many instances it can be advantageous to cut the slot vertically (i.e., parallel—see FIG. 11) or askew with respect to flanges 35 of base plate 23.

While shank 34 of disk 24 in FIG. 6 is shown with a perpendicular arcuate shank surface corresponding to a generally cylindrical shape normal to surface 24' of shoulder 33 as is typical in known prior art securing disks of this type, improvement for use with this invention could be provided where this invention is embodied as an entire (i.e., new equipment) binding and binding securement system.

Figure 7B:
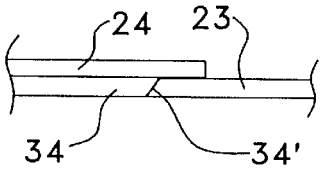
FIG. 7B is a partial side view of a securing disk modified in accord with another aspect of this invention.
Figure 7C:
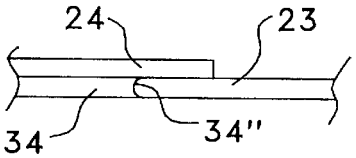
FIG. 7C is a partial side view of a securing disk alternatively modified in accord with this invention.

As shown in FIGS. 7B and 7C, advantage may be afforded by modification of, or deviation from, prior art disks to provide tapered arcuate wall 34' of shank 34 (FIG. 7B), or indenting to form concave wall 34" (FIG. 7C), to increase the area in contact with aperture 36 of base plate 23 without increasing the height or length of shank 34 (in both cases, the arcuate surface of aperture 36 would also be correspondingly modified to take advantage of the additional surface contact). Moreover, concavity 34" on shank 34, by engaging a mating bevelled edge on the arcuate surface of aperture 36 of base plate 23, would tend to keep base plate 23 (including both portions 35' and 35") vertically centered with shank 34.

Returning to FIG. 2, once all the components have been fastened in place, lever 31 is rotated toward the top of the snowboard. This corresponds to the locked position of the device. Preload nut 30 is then tightened on slider 28 reducing the width of slot 37 until the desired normal load is developed between disk shank 34 and central hole 36 of base plate 23. The clamping force thereby attained is the product of the normal load thus developed and the relative coefficient of friction of shank 34 of disk 24 and the mating edge of central hole 36 in base plate 23. A typical coefficient of friction is 0.8. The holding torque is the product of the clamping force and the radius of central hole 36 in base plate 23. Typically the radius of the central hole is about 1.5 inches and normal forces are on the order of several hundred pounds. It follows that holding torques of several hundred inch-pounds are easily achieved.

The middle section of slider 28 and the bore in mounting blocks 26 have the same cross section shapes and are so designed that rotation of preload nut 30 or locking lever 31 does not cause slider 28 to rotate with respect to mounting blocks 26. Locking lever 31 has a central bore with internal threads to engage the threads on slider 28. A variety of thread designs could be utilized, for example ⅜–16 UNF or, preferably, 5/16–0.125 lead–0.062 pitch–double thread. In such cases locking lever 31 advances or recedes axially with respect to slider 28 a distance of from about 0.062 to 0.125 inches (preferably 0.125 inches in most cases) per revolution of the locking lever.

Thus, for about a quarter turn of the locking lever away from the top surface of the snowboard (as would be maximal in most practical applications), slot 37 will open (increase in width) a distance of between about 0.016 to 0.032 inches (preferably 0.032 inches in most cases) at a position adjacent to the slider central axis. This is sufficient to reduce the normal force between shank 34 of disk 24 and central hole 36 of base plate 23 (by movement of base plate portions 35' and 35" away from one another and so expansion of the width of slot 37) such that base plate 23 can be readily and freely rotated with respect to disk 24. In this fashion, the need for loosening and/or removal and retightening of screws 25 to accommodate rotational reorientation of base plate 23 is eliminated (as is the potential for failure over time of a screw and/or related hole in the snowboard due to repeated manipulations of the screws).

Ready free rotation for purposes of this disclosure does not mean absolute resistance to rotation. Some limited resistance to rotation even when locking lever 31 is turned to the release position would appear to be desirable to allow a selected level of user control and stability when the base plate is rotationally released. The selected level of rotational resistance desired in free rotation mode can be preconfigured by slider 28 or locking lever 31 thread selection (for example, by altering thread pitch) or by altering other mechanical parameters such as the nominal fit between disk shank 34 and hole 36 in base plate 23, and/or could be established at the time of initial set up to provide the desired free rotational characteristics.

Figure 8A:
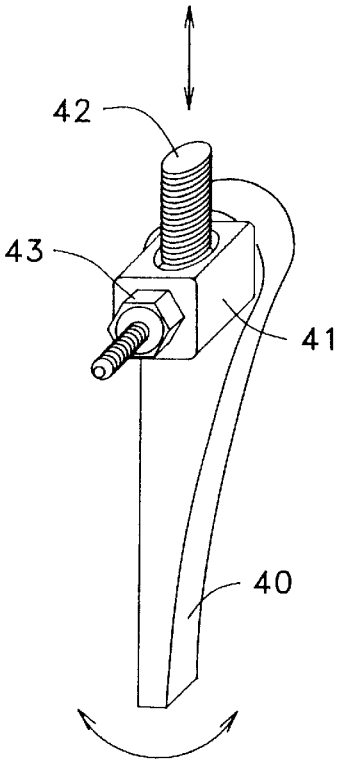
FIG. 8A is an assembly view of the cam, lock mechanism of this invention used to generate clamping force between the base plate and the disk.

FIGS. 8A, 8B, 9 and 10 show a first alternate embodiment of the invention. While the same principle is utilized to generate the clamping normal force, the alternate embodiment uses a cam type mechanism to effect the relative linear displacement of the two mounting blocks. FIG. 8A shows the cam and lever assembly wherein cam lever 40 is constrained to rotate cam surface 46 and journals 44 and 45 (FIG. 8B) in the bores of bushing 41 which causes cam follower screw 42 to move in a generally linear fashion. The assembly is held together by nut 43.

Figure 8B:
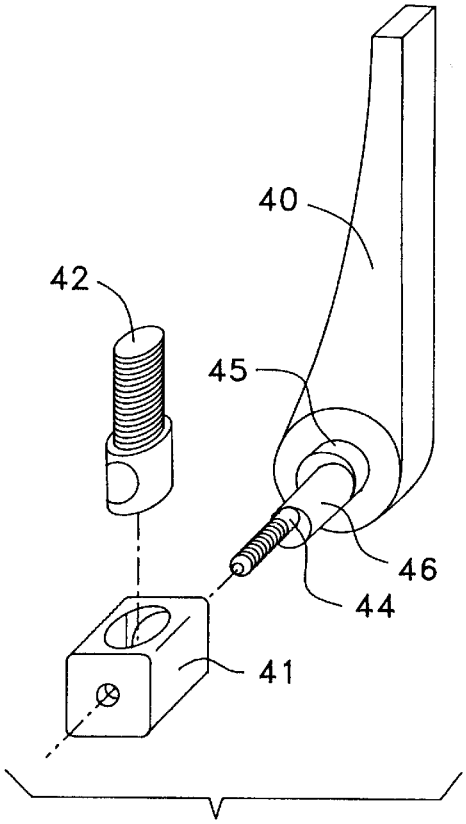
FIG. 8B is an exploded assembly view of the major components of the cam lock mechanism of FIG. 8A.
Figure 9:
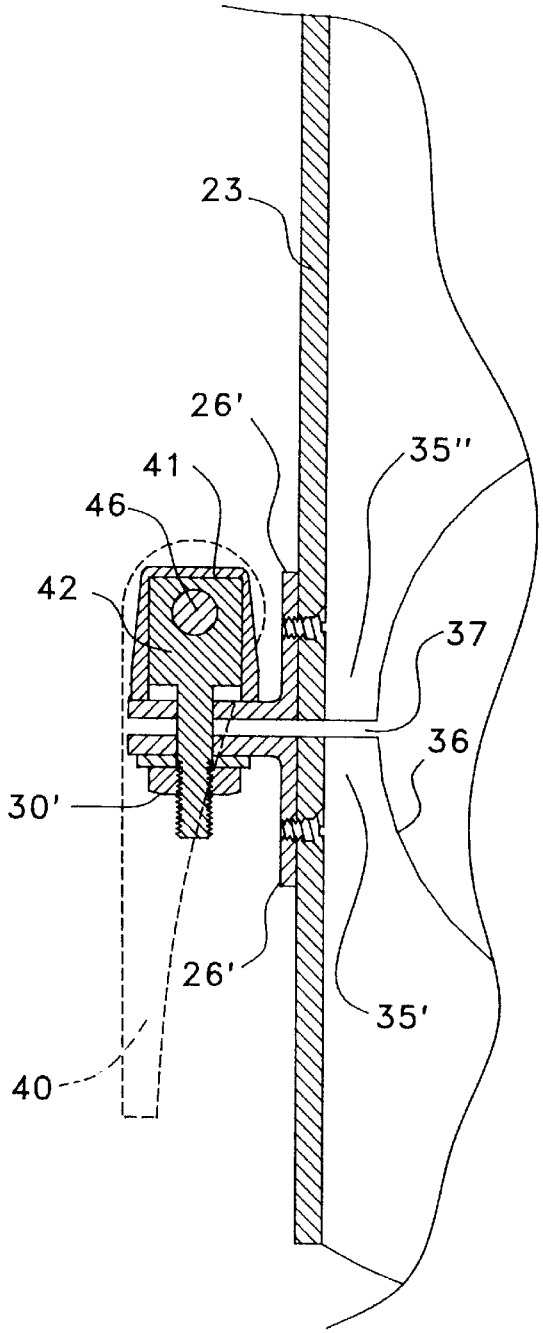
FIG. 9 is a sectional view of the cam lock mechanism in the locked position.
Figure 10:
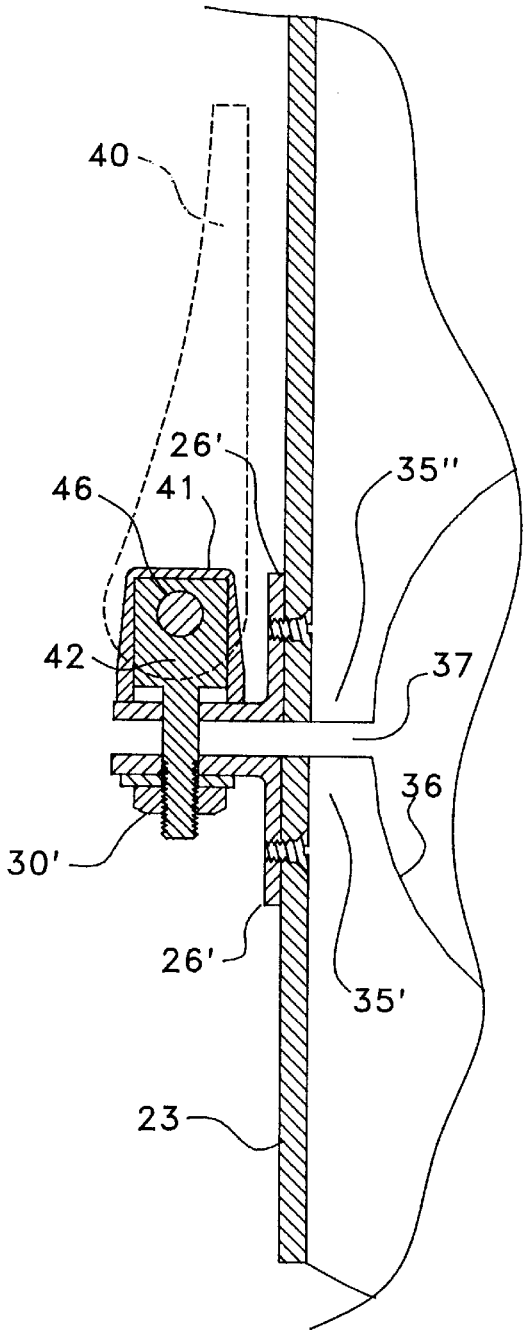
FIG. 10 is a sectional view of the cam lock mechanism in the released position.

FIG. 8B is an exploded view of the cam lock mechanism showing rear bearing surface 44, front bearing surface 45 and eccentric cam 46. A 180 degree rotation of the handle causes follower screw 42 to move linearly a distance of two times the eccentricity of cam 46. FIG. 9 shows a partial top section view of the cam lock mechanism in the locked position and FIG. 10 shows a partial top section view of the cam lock mechanism in the released position. The relative widths of slot 37 are indicated in these two FIGURES. The lever is included for understanding despite the fact that it resides above the section. It is therefore shown in ghosted lines. Mounting blocks 26' are secured to base plate 23. Follower screw 42 of the cam lock mechanism is held through apertures in mounting blocks 26' by nut and washer assembly 30'.

Figure 11:
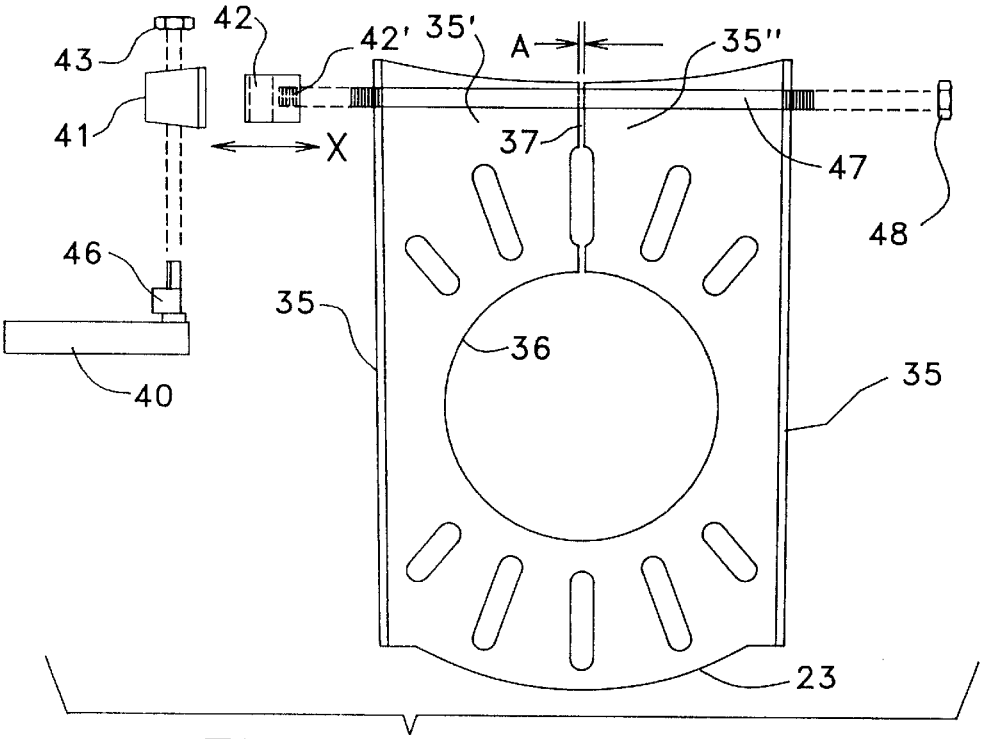
FIG. 11 is a partial exploded assembly view of the cam lock mechanism applied to a base plate which includes a traverse rod.

FIG. 11 shows a second alternative embodiment of the invention using the same cam action principal of the first alternate embodiment in conjunction with a base plate which includes a traverse rod 47 which is used to secure the rider's boot to the base plate by means of a clamp attached to the bottom surface of the boot. Traverse rod 47 normally has tensioning nuts 48 on both threaded ends thereof. The second alternative embodiment is achieved by orienting slot 37 parallel to flanges 35 (again forming base plate sections 35' and 35") and replacing one of tensioning nuts 48 with the cam action device described in the first alternate embodiment. Cam follower screw 42 is altered whereby the external thread thereof is replaced by an internal thread 42' which engages one end of traverse rod 47, thereby essentially employing traverse rod 47 and nut 48 as functional parts of the rotational release and securement mechanism of this invention, as shown in FIG. 11. Slot 37 is preferably cut vertically so as to be substantially perpendicular to the tensioning action of the cam action device. The initial set up and the operation of this embodiment is analogous to that described above for the previous embodiments.

As lever 40 is rotated from the release position to the locked position a compression force develops across the width of slot 37, as indicated by direction "X" in FIG. 11, resulting in a deflection or flexing of the binding which reduces the width of the slot and reduces the effective diameter of aperture 36. The diameter of the aperture reduces only slightly before the aperture engages shank 34 of disk 24. The remaining rotation of the lever to the locked position develops strong normal forces between the aperture of the binding and the shank of the disk.

Whether utilizing snowboard binding straps 49 shown in FIG. 1 or a traverse rod 47 as shown in FIG. 11 (as is may be the case for some step-in type bindings), the teaching of this invention can easily be applied to make the improved rotationally adjustable snowboard binding.

FIG. 7 shows horizontal slot 37 cut into the binding base plate. Slot 37 reduces the stiffness of the base plate. The embodiments shown in FIGS. 2 and 8 through 10 can enhance the performance of such bindings by altering the flex characteristics thereof. The thin webs of the base plate on either side of the disk aperture allow the binding to deflect under load. This is generally undesirable. The devices shown in these FIGURES span the weakest section of the base plate such that the overall stiffness of the modified binding system is increased or decreased to enhance the performance characteristics of the binding. The overall stiffness can be increased by reducing looseness of the sliding fit between slider 28 and mounting blocks 26, by increasing the stiffness of the slider material, or by increasing the separation between the blocks in conjunction with a corresponding increase in the length of the slider. Other means to alter the flex characteristics will be readily apparent to those skilled in the art.

Figure 12:
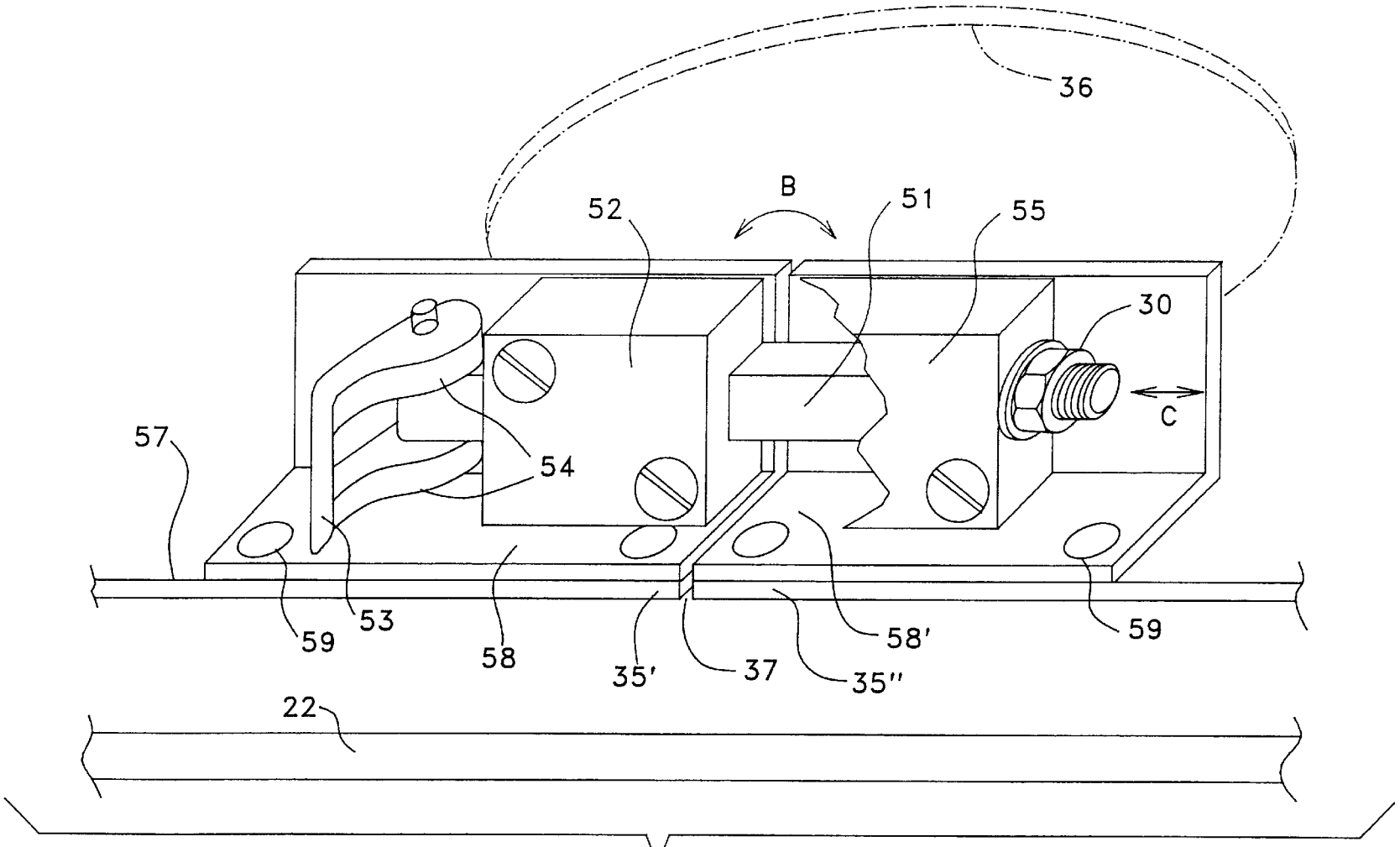
FIG. 12 illustrates an alternative embodiment of this invention in perspective view and which utilizes a cam action locking lever.

FIG. 12 depicts a third alternative embodiment of the invention. It can be adapted to any snowboard binding system that uses a central disk for setting the angle of the base plate with respect to the snowboard and for securing the base plate to the snowboard This embodiment uses all of the principals outlined thus far. The base plate is again cut from one side to the central aperture for the mounting disk as shown in FIG. 7 (forming slot 37 and base plate portions 35' and 35"). As described earlier most base plates include such flanges (35 in FIG. 5A for example). However, in the event that the flanges are not an integral part of the base plate, they can easily be added.

Alternatively, the clamping device can be mounted directly to the flangeless base plate. FIG. 12 shows a flat (flangeless) base plate 57 mounted on the top surface of snowboard 22 with central aperture 36 and slot 37 as discussed hereinabove. Brackets 58 and 58' are mounted to base plate 57 at bores 59 (utilizing screws, for example) or by other suitable means to thus serve as mounting flanges for the rotational release and securement mechanism of this invention. Because the base plate has been cut, the stiffness and flex characteristics have been altered. The base plate is now more compliant and will generally tend to flex with respect to the cut when the appropriate external forces of the rider are applied.

For example, as the rider leans forward and backward, forces are generated which tend to cause relative motion between the sections of the flange immediately adjacent to the cut (slot 37). The relative movement of the binding flanges may be undesirable. If this is the case, the quick release clamping device can be constructed in a manner which reintroduces a prescribed level of stiffness to the binding. Furthermore, it is possible to utilize the locking mechanism to increase the overall stiffness of the base plate beyond that of the original molded plastic or metal base plate.

The embodiment shown in FIG. 12 has the advantage of providing increased overall stiffness to resist the relative motion of the flange sections in the general direction indicated as "B" in the FIGURE. This is accomplished by a close running fit between slider 51 and mounting blocks 52 and 55. When locking lever 53 is rotated to the locked position, the two brackets 58 and 58' (and thus base plate portions 35' and 35") are drawn together in the general axial direction "C" as cam locking faces 54 engage the face of mounting block 52 nearest locking lever 53. This provides a clamping force of base plate aperture 36 against disk shank 34 (as discussed above). Even for low clamping forces this system does not allow motion in the general direction "B" because of the constraint afforded by slider 51 in mounting blocks 52 and 55. Mounting blocks 52 and 55 are attached to brackets 58/58' secured to base plate 57, one on each side of slot 37.

Figure 13:
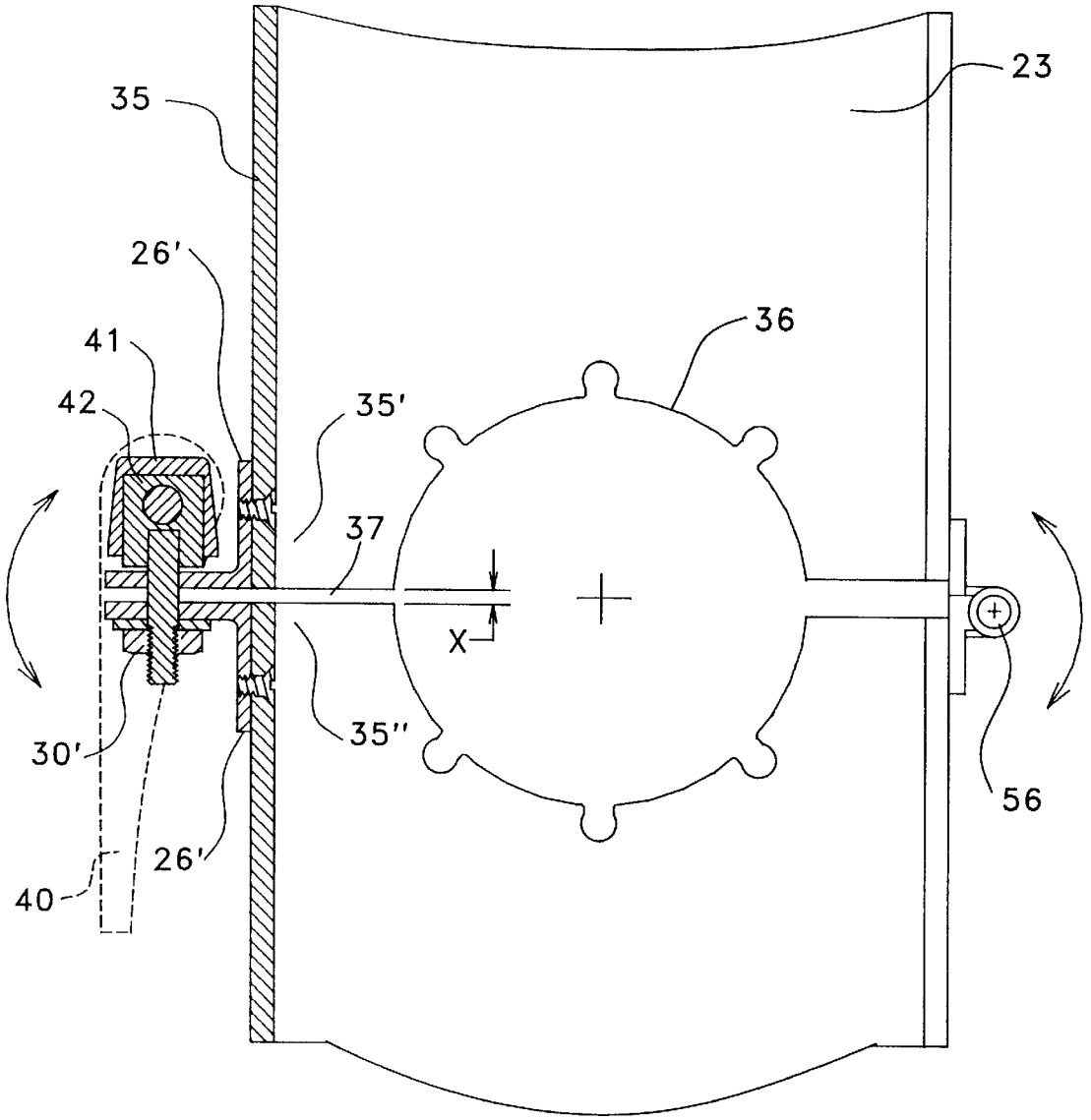
FIG. 13 shows a top view of another embodiment of this invention which includes a hinge (or pivot member) opposite the clamping mechanism.

While it is very cost effective to simply allow the base plate to flex as a means to generate the clamping forces, this may result in very high stresses, especially for plastic base plates. This can be circumvented as illustrated in FIG. 13 by placing an active hinge or pivot 56 on the flange opposite the one with the locking mechanism. In order to provide the requisite stiffness the hinge length can be increased or decreased in the vertical direction. FIG. 13 illustrates a fourth alternate embodiment which has the distinctive characteristic that the clamping force is not generated as a result of the deflection of the base plate material itself, but rather by the relative rotation of base plate portions 35' and 35" (made independent by base plate edge to edge extension of slot 37) which are joined opposite the quick release mechanism by hinge type device 56.

The use of the improved binding is very straightforward. The rider simply secures his or her boot to the binding in the manner and fashion prescribed by the manufacturer of the binding. If the binding is a strap type it is typical that two or more straps 49 must be secured around the boot. If the binding is of the step in type, the rider simple steps into the binding and exerts sufficient downward force to engage the latching system. Once the boot is secure, the rider simply rotates lever 31 shown in FIG. 2 to the release position, then adjusts the angle of the binding to the desired orientation with respect to the snowboard and finally lever 31 is rotated to the locked position to engage aperture 36 against shank 34 of disk 24 thereby preventing further rotation of the binding with respect to snowboard 22.

As may be appreciated, a method for modifying (even retrofitting) known types of snowboard bindings to accommodate toolless rotational release and reorientation of the binding relative to the snowboard is provided by this invention. Slot 37 can be cut in any known type of base plate as described herein between aperture 36 and a convenient outer edge thereof (for example, at flange 35 as shown in FIG. 2, the edge adjacent mid-rod 47 as shown in FIG. 11, or any selected edge for flangeless type base plate 57 as shown in FIG. 12). Thereafter, the release and securement mechanism of this invention adaptable to the particular base plate can be connected to the base plate adjacent to slot 37 as discussed hereinabove (utilizing whatever means may be convenient and effective) to thereby provide selective manipulation of the width of the slot for rotational adjustment and resecurement of the base plate.

Referring to the FIGS. 14 through 17, the elements of an adjustable centering device for snowboard bindings are illustrated in accord with another inventive aspect of this disclosure as it relates to such bindings in general (though the centering device could of course be utilized with the rotationally adjustable binding apparatus of this invention). While the base plate is not shown in these FIGURES, its position and utilization is no different that heretofore described.

The adjustable centering device includes disk 60 with a shoulder and a shank for retaining a binding base plate, as described earlier, and also hollowed out section 61 extending upward from the bottom of the disk. The hollowed out section is shown as a rectangle with rounded corners. It could also have the shape of a slot with full radius round ends or other shapes as will become apparent. The disk has central bore 62 approximately 0.75 inches in diameter. The disk is about four inches in diameter and approximately 0.188 inches thick.

Figure 14:
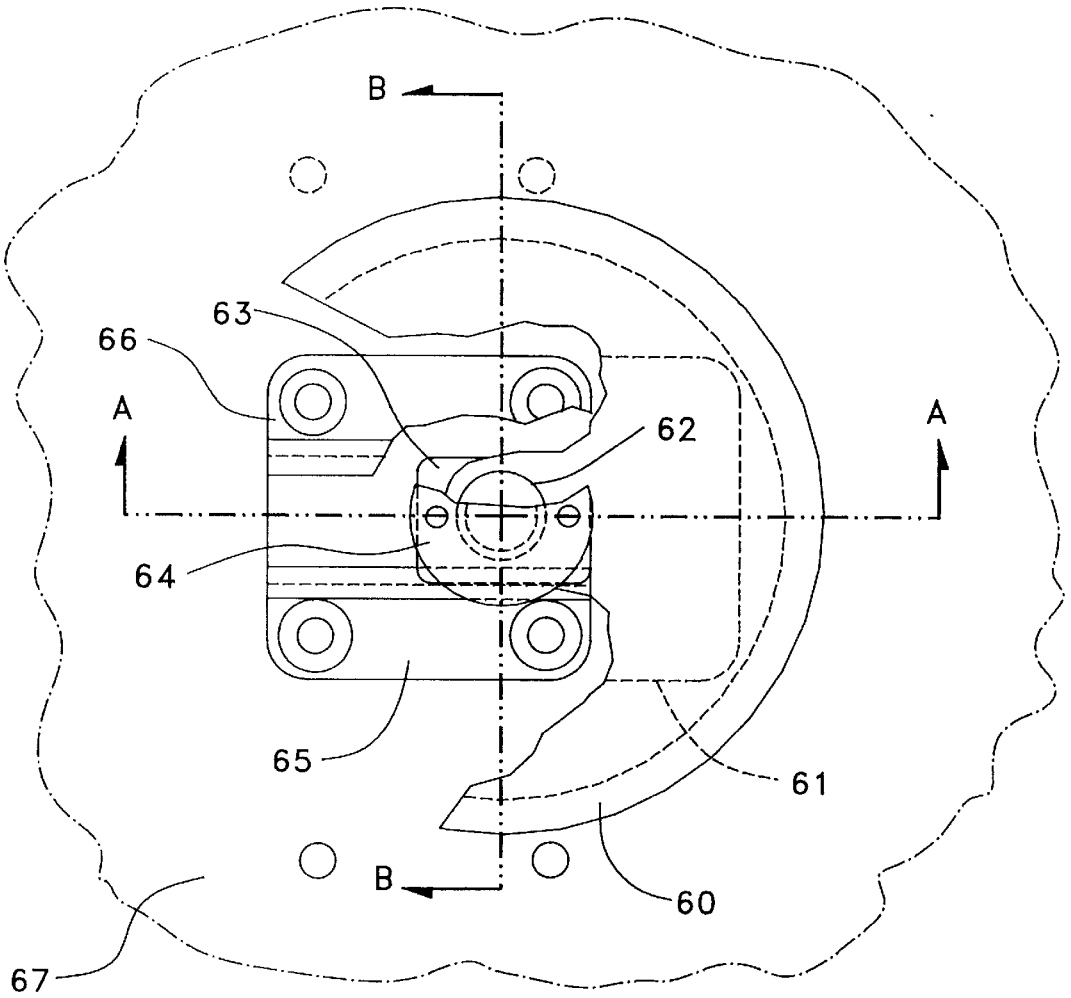
FIG. 14 is a partially cutaway top view of an adjustable centering device in accord with another inventive aspect of this disclosure.
Figure 16:
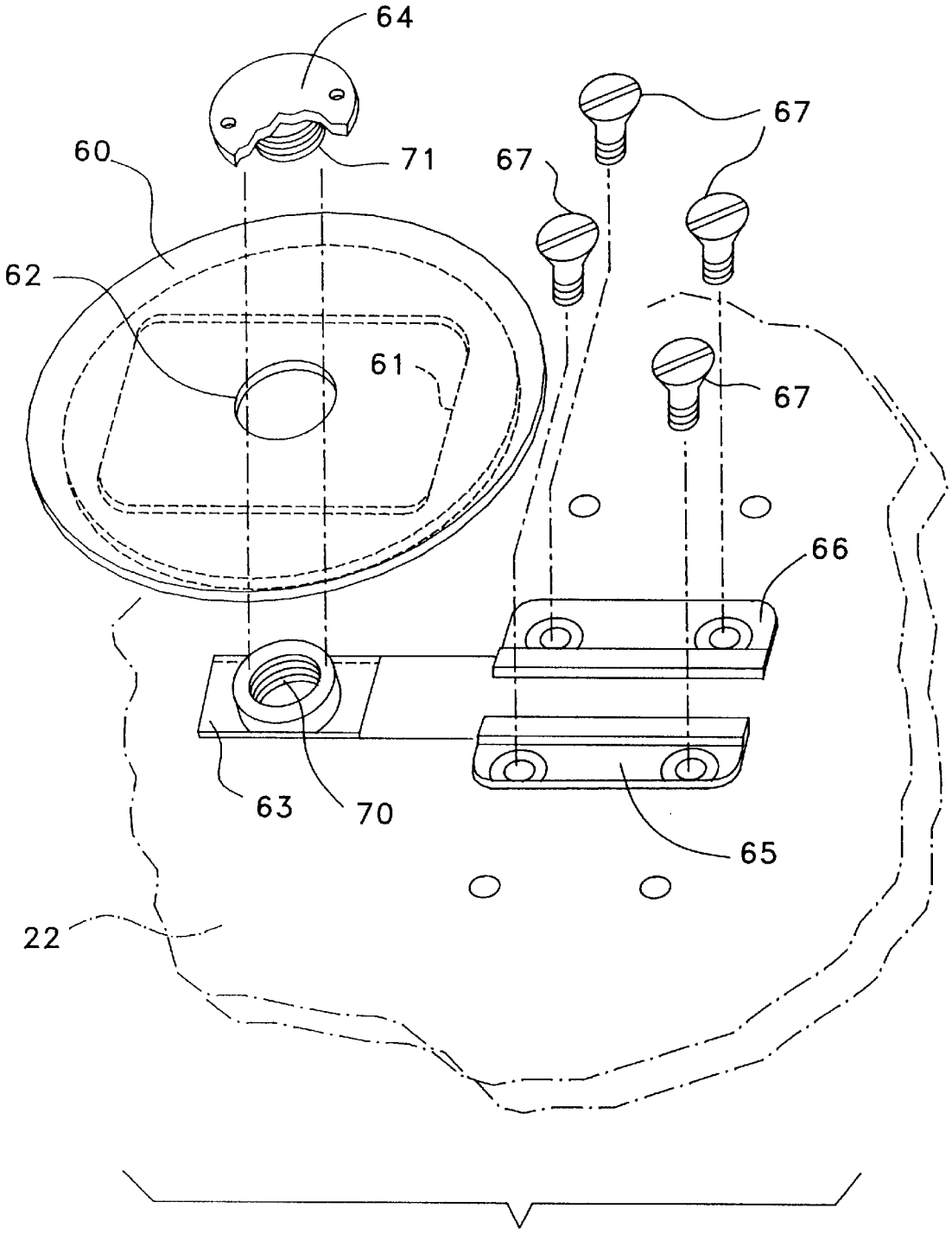
FIG. 16 is an exploded view of the centering device relative to the top surface of a snowboard.
Figure 15:
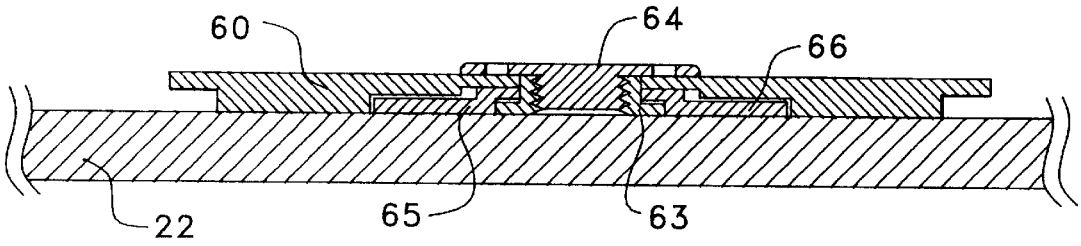
FIG. 15 is a section view of the centering device of FIG. 14 taken along section line B—B of FIG. 14.

FIG. 15 shows a cross section of the centering device taken along the section line B—B of FIG. 14 (the front of the snowboard as viewed in FIG. 14 is at the top of the page). Referring to the exploded view shown in FIG. 16, T nut 63 extends through central bore, or aperture, 62 of disk 60 and has threads 70 to, engage threads 71 of lock bolt 64. The lock bolt is shown as a spanner type, but it could also engage with a hex wrench, phillips screwdriver or other convenient tool. When lock bolt 64 is loose the assembly consisting of lock bolt 64, disk 60, and T nut 63 are free to move linearly to the left and right in FIG. 14 along track brackets 65 and 66 anchored to snowboard 22 with screws 67 or other suitable anchoring means. Hollowed out section 61 of disk 60 limits the travel of the assembly when the lock bolt is loosely engaged.

Figure 17A:
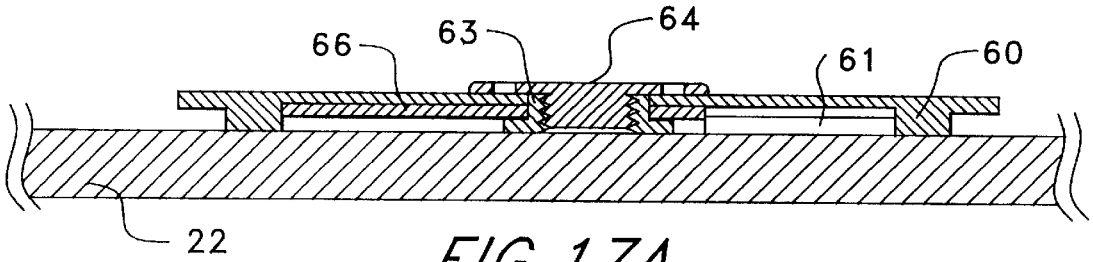
FIGS. 17A through 17C are sectional views of the centering device (taken along section line A—A of FIG. 14)
Figure 17B:
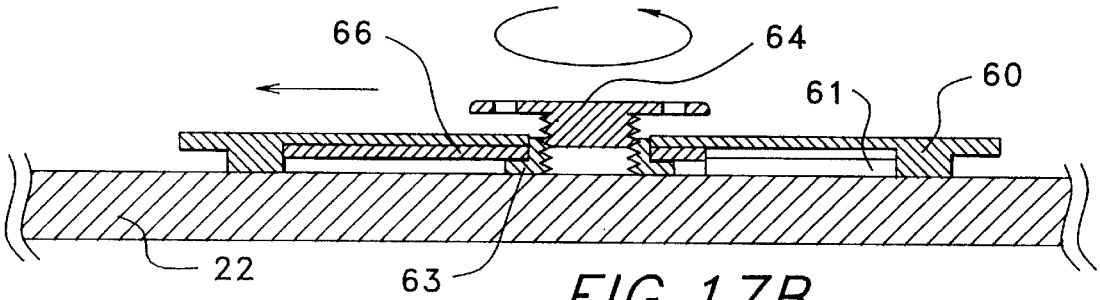
Figure 17C:
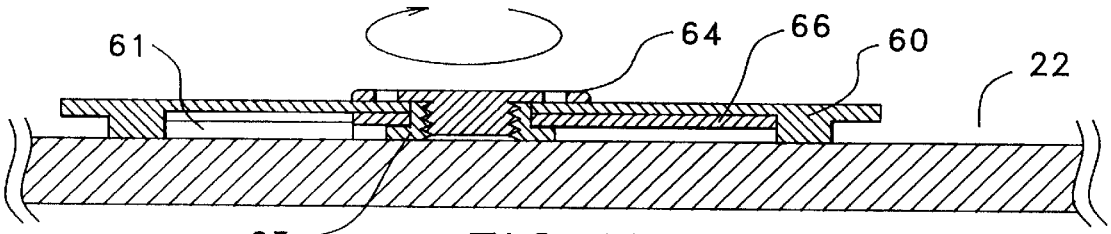

FIGS. 17A, 17B, and 17C illustrate the operation of the centering device. In FIG. 17A disk 60 is shown positioned in its rightmost position which would most beneficially position the center line of the disk to the right of the longitudinal center line of snowboard 22. As shown in FIG. 17B, lock bolt 64 is loosened so as to allow the left to right linear movement of disk 60, T nut 63 and lock bolt 64. When the desired left to right, or lateral centering has been achieved, lock bolt 64 is tightened so that the flange of T nut 63 engages the bottom surface of track brackets 65/66 the disk 60 is squeezed between the top of track brackets 65/66 and lock bolt 64 with sufficient normal force and friction to prevent disk 60 from slipping.

The secured new position shown in FIG. 17C is the leftmost position of the centering device. With a four inch diameter disk the device can easily allow a left to right adjustment of the disk center line of about +/−0.50 inches. This is more adjustment than that allowed by the arrangements found in most current three and four hole disks. Moreover, since screws anchored in the snowboard are not being frequently loosened and retightened to accommodate adjustment, the likelihood of screw or hole failure, and thus binding failure, is substantially reduced.

In summary, this invention provides a new and novel apparatus for fastening a binding to a snowboard which allows ready adjustability and binding flexibility while overcoming the shortcomings and disadvantages of the prior art noted hereinabove. The rotationally adjustable apparatus of this invention provides a low cost, lightweight simple and reliable means to fasten the binding to the snowboard which has the following unique and desirable features: ability to enhance the performance characteristics of the binding by increasing or decreasing the overall flexibility of the binding system; quick, continuously adjustable reorientation of the binding without removal of boot (i.e., user initiated free rotational movement of the boot relative to the board); uses industry standard snowboard hole patterns; allows fine tuning of performance by adjustment of the center of the binding with respect to the snowboard; allows the bottom of the rider's boot to contact the top surface of the binding and securing disk, eliminating undesirable vertical offset; the specific orientation of the hold down plate is not predefined, thus there is no need for multiple unique orientations of the hold down plate; and the clamping torque can be set to a prescribed level such that the base plate can rotate with respect to the snowboard when the set torque threshold is exceeded at the binding.

The adjustable lateral centering device of this invention provides for quick and easy, even where necessary on-slope, change over and fine adjustment of binding position laterally on the board to accommodate different users or conditions, a feature not now available to snowboard users or providers.

What is claimed is:

1. A rotationally adjustable binding for binding a user's boot to a top surface of a snowboard, said binding anchorable to the snowboard by a securing member that is attached to the snowboard, said binding comprising:

a base plate configured to be supported by the top surface of the snowboard and to receive thereat the user's boot, said base plate having an aperture therein and an outer edge with said aperture configured for receipt therethrough of the securing member, a continuous slot being formed between said aperture and said outer edge thus defining first and second base plate portions at each side of said slot, said slot having a width between said base plate portions; and rotational release and securement means connected with said base plate adjacent to said continuous slot and including a manipulable portion, said rotational release and securement means for selectively governing said width of said slot and thereby relationship of said aperture to the securing member by user movement of said manipulable portion between rotational release and rotationally secure positions, said base plate being rotatable relative to the securing member when said manipulable portion is moved to said rotational release position and secured from rotation relative to the securing member when said manipulable portion is moved to said rotationally secure position.

2. The binding of claim 1 further comprising first and second mounts associated with said base plate, one on each side of said continuous slot at different ones of said first and second base plate portions, and wherein said rotational release and securement means includes a releasable locking member that is responsive to movement of said manipulable portion and is operatively associated with said mounts.

3. The binding of claim 2 wherein said releasable locking member includes a camming member.

4. The binding of claim 2 wherein said releasable locking member includes a slider threadably engageable with said manipulable portion.

5. The binding of claim 4 wherein said slider and said first and second mounts are configured so that said slider is nonrotatably held at said first and second mounts.

6. The binding of claim 1 wherein said base plate includes a flange at said outer edge, said rotational release and securement means being connected with said flange.

7. The binding of claim 2 wherein said first and second mounts are flanges, said binding further comprising a traverse rod retained at said first and second mounts, said rod spanning said base plate and said slot, said releasable locking member of said rotational release and securement means being connected at one end of said traverse rod adjacent to one of said mounts.

8. A selectively freely rotatable binding for securing a user's boot to a top surface of a snowboard, said binding comprising:

a base plate configured to be supported by the top surface of the snowboard and to receive the user's boot thereat, said base plate having a central arcuate aperture therethrough and an outer edge, a continuous slot being formed between said aperture and said outer edge thus defining first and second base plate portions at each side of said slot, said slot having a width between said base plate portions;

a securing member having an arcuate shank receivable through said aperture of said base plate and a shoulder for restraining said base plate between said shoulder and the snowboard, said securing member being connectable at the snowboard, said base plate being in contact with said shank at said aperture; and rotational release and securement means connected with said base plate at each of said base plate portions and including a manually manipulable portion said rotational release and securement means for selectively governing said width of said slot and thereby contact relationship of said aperture and said shank of said securing member by user movement of said manually manipulable portion between rotational release and rotationally secure positions, said base plate being rotatable around said shank of said securing member when said manipulable portion is moved to said rotational release position and secured from rotation around said shank of said securing member when said manipulable portion is moved to said rotationally secure position.

9. The binding of claim 8 wherein said base plate includes a flange at said outer edge, said rotational release and securement means being connected with said flange.

10. The binding of claim 8 further comprising first and second mounting brackets connected with different ones of said first and second base plate portions, said rotational release and securement means being held at said first and second mounting brackets.

11. The binding of claim 8 wherein said slot traverses said base plate through said central arcuate aperture, and wherein said first and second base plate portions are connected by a hinge at an end of said slot opposite said outer edge of said base plate.

12. The binding of claim 8 wherein said rotational release and securement means includes one of a camming member and a threaded slider connected with and responsive to movement of said manually manipulable portion.

13. The binding of claim 8 wherein said base plate includes first and second flanges with said outer edge extending between said first and second flanges, said binding further comprising a traverse rod retained at said first and second flanges, said rod spanning said base plate and said slot, said rotational release and securement means being connected at one end of said traverse rod adjacent to one of said flanges.

14. The binding of claim 8 wherein said arcuate shank of said securing member has one of a tapered and a concave surface, and wherein said base plate at said central arcuate aperture has an edge surface configured for mating contact with said surface of said shank of said securing member.

15. The binding of claim 8 wherein said securing member includes an aperture therein, said binding further comprising a laterally adjustable anchoring comprising:

track means connectable to the snowboard;

a connector constrained by and yet linearly movable along said track means; and tightening means releasably engagable with said connector through said aperture of said securing member.

16. A method for modifying a snowboard binding to accommodate toolless rotational release and reorientation of the binding relative to the snowboard, the binding including a base plate for receiving a user's boot thereat between edges thereof and a securing member receivable through an aperture in the base plate and affixable to the snowboard, said method comprising the steps of:

forming a slot in the base plate between the aperture and an outer edge thereof; and connecting user manipulable release and securement means with the base plate adjacent to said slot for selectively manipulating width of said slot.

17. The method of claim 16 further comprising the steps of associating first and second mounts with the base plate, one on each side of said slot, and connecting said rotational release and securement means with said mounts.

18. The method of claim 17 further comprising the step of providing a manually manipulable portion at said release and securement means for user selected movement between rotational release and rotationally secure positions, the base plate being rotatable relative to the securing member when said manipulable portion is moved to said rotational release position changing said width of said slot and secured from rotation relative to the securing member when said manipulable portion is moved to said rotationally secure position.

19. The method of claim 16 wherein the step of connecting a user manipulable release and securement means with the base plate includes connecting a manually manipulable portion with one of a cam member and a threaded slider held across said slot.

20. The method of claim 16 wherein the binding includes a traverse rod retained between first and second flanges extending along opposite sides of the base plate, the traverse rod spanning the base plate and said slot, the flanges having said outer edge of the base plate extending therebetween, the step of connecting user manipulable release and securement means including connecting said release and securement means at one end of the traverse rod adjacent to one of the flanges.

21. The method of claim 16 further comprising the step of forming one of a tapered and a concave surface at an arcuate surface of the securing member receivable through the aperture in the base plate, and forming a mating surface at an edge of the base plate defined by the aperture that is configured for mating contact with said arcuate surface of the securing member.

* * * * *